United States Patent [19]

King

[11] Patent Number: 5,031,734

[45] Date of Patent: Jul. 16, 1991

[54] FLEXIBLE LUGGAGE CASE AND FRAME PANEL THEREFOR

[75] Inventor: William L. King, Denver, Colo.

[73] Assignee: Samsonite Corporation, Denver, Colo.

[21] Appl. No.: 476,870

[22] Filed: Feb. 8, 1990

[51] Int. Cl.[5] ..... A45C 5/02; A45C 5/14; A45C 13/36

[52] U.S. Cl. ..... 190/122; 190/40; 190/113; 190/124; 190/125; 190/127

[58] Field of Search ..... 190/25, 40, 119, 125, 190/127, 113, 124, 122, 123; 428/902

[56] References Cited

U.S. PATENT DOCUMENTS

| | | | |
|---|---|---|---|
| 425,247 | 4/1890 | Palica | 190/25 |
| 1,403,476 | 1/1922 | Axelman | 190/119 X |
| 1,751,936 | 3/1930 | Lowe | 190/119 X |
| 1,999,064 | 4/1935 | Marks | 190/119 |
| 2,740,506 | 4/1956 | Davis | 190/113 X |
| 2,746,581 | 5/1956 | Ritter, Jr. | 190/119 X |
| 3,071,220 | 1/1963 | O'Neil | 190/127 |
| 3,335,827 | 8/1967 | Hofferbert | 190/127 X |
| 3,730,308 | 5/1973 | Pelavin | 190/127 X |
| 4,176,734 | 12/1979 | Wang | 190/127 X |
| 4,419,400 | 12/1983 | Hindersinn | 428/902 X |
| 4,544,051 | 10/1985 | Saltz | 190/127 X |
| 4,561,525 | 12/1985 | Shidner | 190/127 X |
| 4,610,334 | 9/1986 | Pelavin | 190/127 X |
| 4,817,802 | 4/1989 | Pratt | 190/113 X |
| 4,951,818 | 8/1990 | Johnson | 190/127 X |

FOREIGN PATENT DOCUMENTS

| | | | |
|---|---|---|---|
| 305207 | 3/1989 | European Pat. Off. | 190/119 |
| 2006255 | 8/1971 | Fed. Rep. of Germany | 190/119 |
| 2756089 | 6/1979 | Fed. Rep. of Germany | 190/127 |
| 2827199 | 1/1980 | Fed. Rep. of Germany | 190/40 |
| 147812 | 4/1981 | Fed. Rep. of Germany | 190/125 |
| 986708 | 8/1951 | France | 190/127 |
| 2519526 | 7/1983 | France | 190/119 |
| 1441790 | 7/1976 | United Kingdom | 190/127 |

*Primary Examiner*—Sue A. Weaver

*Attorney, Agent, or Firm*—Gregory W. O'Connor

[57] ABSTRACT

Some softsided cases (luggage cases with cloth panel bodies) include the frame structures to hold them erect and give them some structural rigidity. The ability of such frame members to withstand crushing forces without damage varies considerably. Also, the weight of such frame members can work against the inherent lightness of softsided luggage. Disclosed is a luggage case and a frame member for the luggage case which includes a panel. The panel comprises a pair of cloth laminae attached to one another at a peripheral seam structure. Between the laminae are positioned flexible elongated members preferably along the diagonals of the laminae if the laminae has a rectangular or trapezoid shape. These elongated members are engaged at the corners by holding means which have sockets to receive the elongated members, and specially shaped outer edges which engage a substantial portion of the peripheral seam at the corners. The elongated members cross one another in the middle of the panel. These loosely held flexible elongated members are capable of extreme flexural distortion. The elongated members are sized and positioned to provide a pretensioning force on the laminae and the case to provide stiff resiliency and to hold the case erect in normal travel yet to give and move flexibly to permit the case to be crushed repeatedly and completely without preceptible permanent damage to the panel.

23 Claims, 2 Drawing Sheets

FLEXIBLE LUGGAGE CASE AND FRAME PANEL THEREFOR

BACKGROUND OF THE PRIOR ART

This invention relates to luggage cases, in particular, to luggage cases having the body portions thereof primarily made of fabric panels. Called softside luggage, such fabric paneled luggage may include a frame member typically of formed steel, wood or plastic which holds the fabric body of the case erect. This gives the luggage a generally box like form for easy packing, to stabilize its shape during travel, and to provide some protection to the contents of the otherwise collapsible fabric body.

More particularly, this invention relates to luggage frame systems which can be characterized as flexible in contrast with rigid box like constructions over which the fabric body is sometimes sewn, stretched or adhered. Such prior flexible frame systems have included extruded PVC or ABS polymer frames which have bent corners and are riveted or are otherwise firmly attached to a plywood bottom board. This frame provides a somewhat flexible, light construction and permits the finished luggage case to be crushed, at least partially, without permanently distorting the luggage case and making it unusable. While such prior art frames have solved some of the problems of steel or spring operated frame systems, the crush resistance of the case is limited and the frame has some risk of being permanently distorted from extreme use conditions. Also, such prior art frames can not be easily made to enhance certain desired styles or shapes of the fabric luggage case. Also, it is difficult to provide the fabric body of the case with a taut, neatly tailored look.

In another frame system, a complex series of metal frame sections and compressible spring sections have been used successfully to pre-tension the fabric drum-type construction of the body portion. This frame, however, requires considerable hand work and, like any prior art metal frame, was subject to permanent distortion if overstressed or crushed.

OBJECTS OF THE INVENTION

Accordingly, it is an object of the present invention to provide a fabric body luggage case with a panel for the frame which is capable of extreme distortion to the point of crushing the case and yet, is capable of springing back completely, being substantially unaffected by such crushing stresses.

It is also an object of the present invention to provide an extremely light and durable element for a frame of a fabric luggage case so that the overall weight of the luggage case is kept at a minimum while providing considerable structural support and resiliency.

It is also an object of the present invention to provide a panel for use as a frame member for a luggage case which can provide a pretensioning force to the luggage case and, thus, impart a neat tailored look to the luggage case while being simple to construct and dependable in its use and operation.

BRIEF DESCRIPTION OF THE INVENTION

The invention includes a luggage case having a body of fabric panels supported over a frame means. The frame means includes a least one panel which in turn comprises at least one flexible elongated member having a flexural modulus of at least about $1.0\times10^6$ psi, preferably between about $3.0\times10^6$ psi, with its elastic yield stress approximately equal to its ultimate stress. Means are provided for loosely attaching the elongated member to the frame means whereby the ends of the elongated member can be brought together repeatedly, as when the luggage case is crushed, without substantial harm. Preferably, the frame panel includes at least two of these elongated members with the elongated members being sandwiched between flexible laminae—preferably fabric panels. These fabric panels are sewn to each other at their peripheries forming a seam means which functions as the loose attaching means. The elongated members preferably are provided with means for holding the elongated member and for simultaneously engaging a substantial portion of this seam means. The preferred embodiment of the panel has four corners and the holding means engages this seam at these corners.

This holding means includes at least one socket for receiving the end of the elongated means and a seam engaging edge opposite that socket. This edge has a shape or contour which substantially corresponds to the contour of the seam means at the corners. Preferably, the elongated members extend along a diagonal of this panel from one corner to the opposite corner with the pair of the elongated members crossing one another at the middle of the panel. Versatility is provided by having the holding means include several sockets so that the panel can include four elongated members arranged in pairs along each diagonal.

Also contemplated by this invention is a structural panel for a flexible luggage case or the like comprising of generally planar lamina having a predetermined peripheral shape. This lamina is formed of a material which can resist stretching but is capable of repeated folding or crushing without damage. The peripheral shape includes some corners. A first elongated member is attached to that lamina at two corners. A second elongate member is attached to the lamina at least at the corners such that the elongate members cross one another inward of the corners of the periphery. These elongated members have resiliency characteristics such that opposite ends of the panels can be brought in contact with each other without appreciable damage to the panel and elongate members. Preferably, the panel includes at least two of these crushable and nonstretchable lamina attached to one another at their peripheries to form a seam means. The panel further includes a seam engaging means, one for each corner of the seam. This seam engaging means includes at least one socket for receiving an end of the corresponding elongate member and a seam engaging edge having a contour which corresponds to the seam at the corresponding corner. At least one of the laminae comprised of cloth panel which includes a zipper closure for selected access to the elongate means between the two laminae. Each of the elongate members preferably compromise a material having a flexural modulus of at least about $1.0\times10^6$ psi, a flexural strength of at least about 60,000 psi, and an elastic yield stress about equal to its ultimate flexural stress. Preferably, the chosen material has a flexural strength of about 120,000 psi and a flexural modulus of about $6.0\times10^6$ psi.

Figure 1:
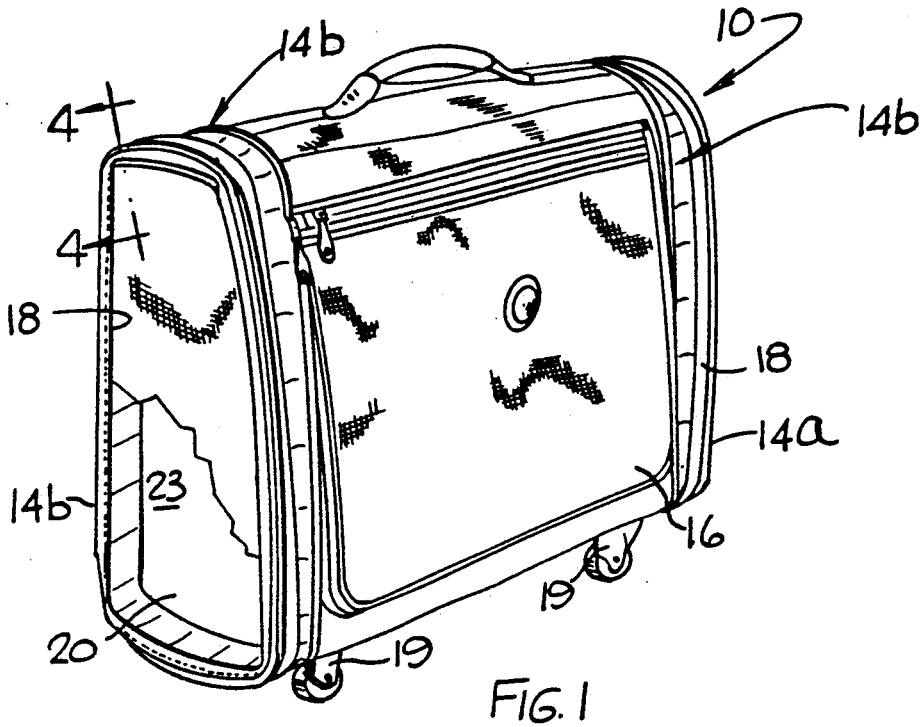
FIG. 1 shows a luggage case embodying the panel frame of the instant invention.

Referring to the figures where like numerals refer to like structures, luggage case 10 is the "pullman" type which includes wheels 19, a main packing compartment with a door access 16 thereto and preferably includes end pockets 18 and 18, also zipper accessed. Overall, the body of the case is similar to a commercial product called "The Lightweight" available from Samsonite Corporation, Denver, Colo. This luggage case has a generally trapezoid shaped end view and is composed of lightweight fabric having peripheral seams which follow that trapezoid contour at each end panel and also slightly inboard of each end panel to define the transition between the end pockets 18 and the main packing compartment. In particular, the preferred embodiment has a first seam means 14(*a*) which extends around the extreme ends of the luggage case and a seam structure 14(*b*) which extends around the perimeter of the case between the end pockets 18 and the main packing compartment. The seam structures include beading or piping to give a crisp, tailored look and also to make the edges more durable.

In the preferred embodiment the structural panel 20 is positioned between the end pockets 18 and the main packing compartment. The structural panel 20 is defined in its outside perimeter by the seam structure 14(*b*) which, among other things, attaches together two tough, flexible laminae—a cloth panel 23 and a second cloth panel 24.

Figure 2:
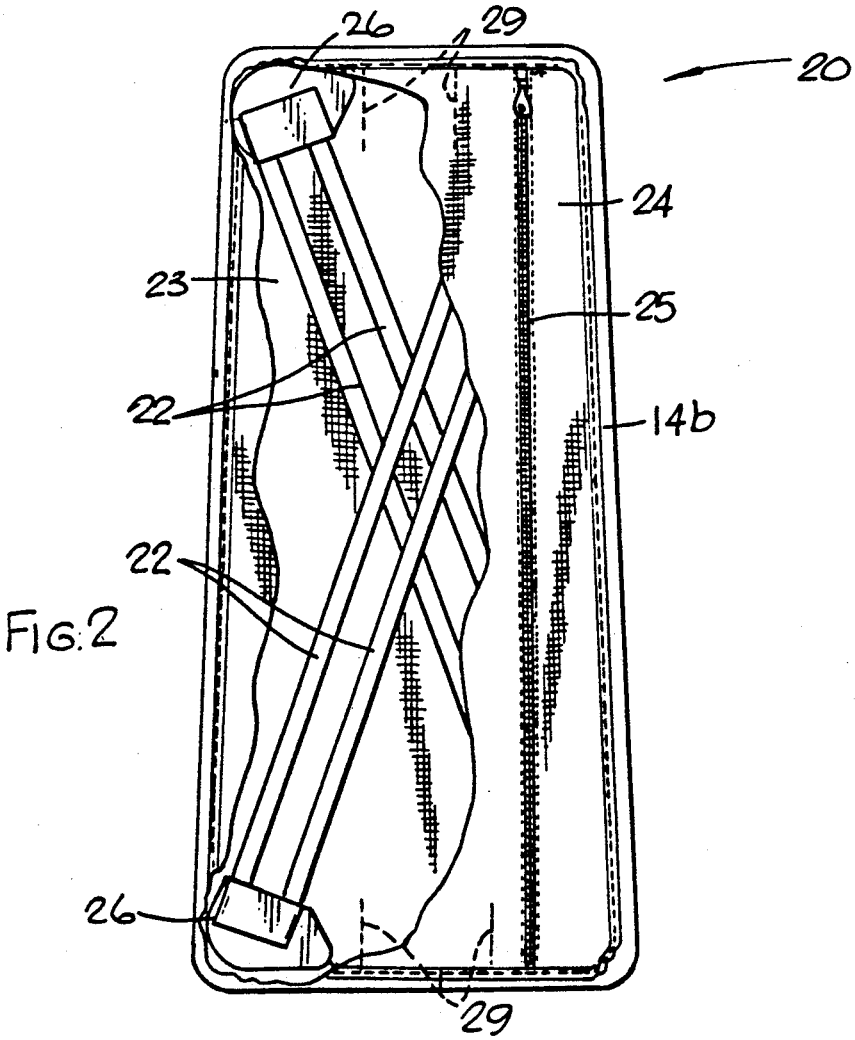
FIG. 2 shows a structural panel made in accordance with the instant invention.

The seam structure 14(*b*) also serves to loosely attach the panel 20 to the rest of the frame of the case. Sandwiched between these two cloth panels are a plurality of elongated flexible members 22. While other configurations are possible, preferably the elongated members 22 extend along the diagonals of the generally rectangular shape of the panel as shown in FIG. 2. In the preferred embodiment shown, four elongated members 22 in two parallel pairs are positioned along these diagonals. The elongated members cross one another near the geometric center of the end panel. The elongated members are not bonded or attached in any way to one another at the center and during flexing can move away from one another and slide along one another easily.

The ends of the elongated members are held in position relative to one another and to the seam structure 14(*b*) by holding means 26 which comprises a molded plastic member. Along the long dimension of one of the fabric lamina 24 is a zipper closure means 25. This zipper closure means provides easy access to the space between the fabric lamina 23 and 24 when the elongated members and their holding means 26 are being installed. Also, should the structural members become damaged, they can be replaced by access through this zippered closure. Preferably, its zipper slider does not include a zipper pull to discourage the user of the luggage case from access between the laminae.

Figure 3:
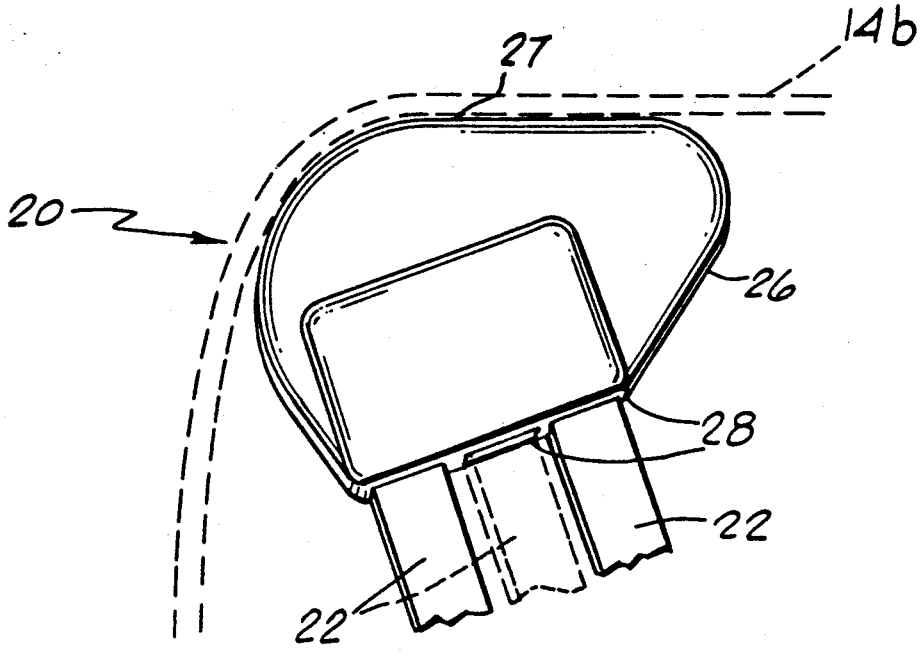
FIG. 3 is a detail of a portion of this structural panel.

FIG. 3 shows one of the holding means 26 in detail. Preferably this is a thermoplastic injection molded part having a thickened portion which includes sockets 28 for receiving one, two or three elongated members 22. Opposite the socketed portion of 26 is a contoured edge 27 which engages the seam structure. As can be seen in FIG. 3 this contoured edge may include a rounded portion which corresponds to the tailored corner of the panel 20. It includes a longitudinal or straight section which is shaped to bear on an end portions of the corresponding wood plates 15 (either the top board or bottom board) which constitutes the remainder of the preferred frame structure for the case. The fabric lamina 23 and 24 may also be stitched at 29 as shown in FIG. 2. These stitching lines do not firmly embrace the holding means 26 but loosely locate restrain in the corners and prevent their displacement which could occur during extreme stress or abuse of the luggage case.

Figure 4:
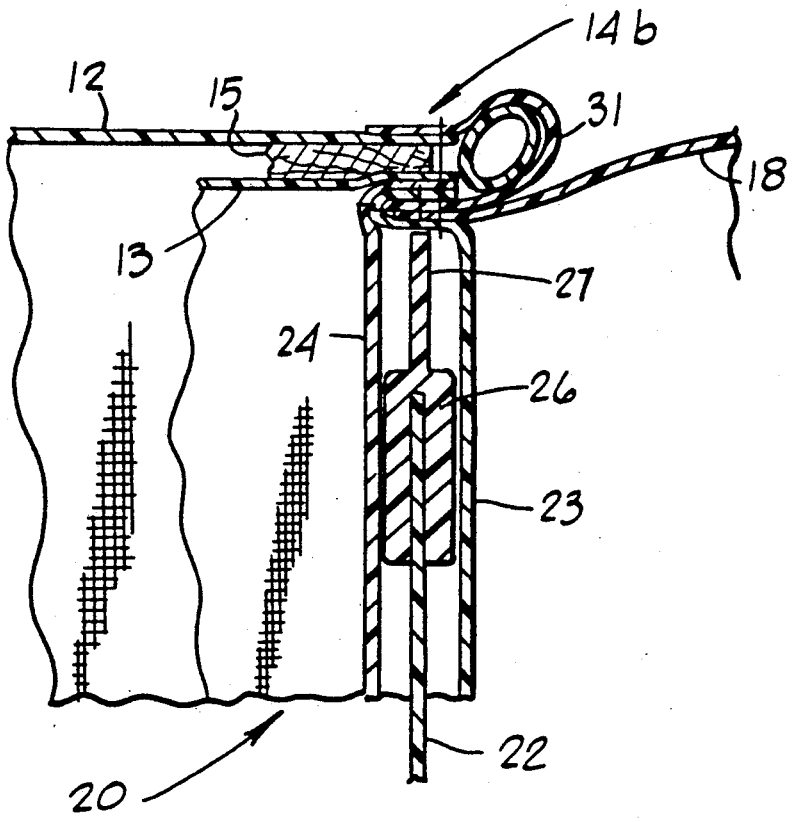
FIG. 4 is a cross-section view taken along line 4—4 of FIG. 1.

In FIG. 4, the cross-section of an end portion of the luggage case 10 is shown. Here, the upper edge 27 of the holding means is shown to engage and bear against a portion of the seam structure 14(*b*). The seam structure 14(*b*) preferably includes the edge portions of cloth lamina 23 and 24; the terminal edges of the lining cloth 13 as well as an edge of fabric body 12, edge beading 31 and an edge of the cloth forming the end pocket 18. These can all be stitched in one or more operations and provide not only attachment and termination for the respective cloth and beading portions, but also a considerably strong multi-layered structural element which is used as will be detailed.

As stated before, the contoured edge 27 of the holding means 26 pushes up through a portion of this seam structure against the board 15, in this case, the top board. It should be understood that a similar arrangement is found at the engagement between the corresponding holding means 26 and the bottom board (not shown). The elongated members 22 are sized to provide a substantial outward force along the diagonals against the seam structure. This pretensions the lamina 23, 24, and if properly sized, the cloth body of the luggage. This pretensioning has the desirable effect of giving a tailored, crisp look to a case. Also, because of the characteristics of the elongated members 22, this pretensioning can be expected to remain for the useful life of the case, thus providing a tailored look for a substantial portion of the life of the case without the considerable weight often associated with multiple laminates, interfacings, etc., sometimes provided to the body cloth of luggage to accomplish this purpose.

The elongated members 22 have special characteristics which are important to this structural arrangement. First of all, the preferred material comprises unidirectional glass fiber reinforced vinyl ester, thermosetting plastic pultruded composite having a high proportion (about 60%–76%) of glass fibers to plastic matrix material. The material for a prototype luggage constructed according to this invention was obtained from Glasforms Inc., 271 Barnard Avenue, San Jose, Calif. 95125. In particular, the preferred fiber reinforced materials have elastic yield strengths which approximately equal, or at least are undistinguishable from, their flexural strengths as defined above. Prototype luggage used this material in the form of strips of generally rectangular cross section which is generally uniform along its length with a generally uniform thickness dimension of about 0.08" and a width of about 0.375". The selected material has extremely tough and resilient structural characteristics to withstand the rigors to which the luggage case may be put. In particular, the preferred material has a flexural strength (per ASTM test procedure D4476/790) of at least about 60,000 psi, preferably about 120,000 psi, and a flexural modulus (per ASTM test procedure D4476/790) of between $1\times10^6$ psi and $6\times10^6$ psi. Unlike conventional luggage frame materials such as steel and thermoplastic, these preferred materials experience very little permanent set or strain when flexed.

This permits FRP material of the above characteristics to have the restoring force adequate to provide the pretensioning and structural stabilizing affect desired, yet panels constructed with elongated members of these materials can be bent so that their ends touch without permanent degradation or deformation. In fact, a luggage case made in accordance with the instant invention having elongated materials of the above preferred characteristics have been crushed between 10,000 and 15,000 times before substantial permanent degradation occurred.

The inherent toughness of the fiber reinforced plastic material may be used to full advantage of by selecting elongated members with dimensions according to the following criteria. It has been found that the length to thickness ratio, that is the ratio of the effective length of the elongated member (the actual length of the member plus the extension to that length provided by the molded holding means 26 on each end) to the narrowest cross-sectional dimension should be at least about 183 to about 260, preferably between 200 and 260. The stiffness desired to support varying sized luggage cases is obtained by keeping the Aspect Ratio (the ratio of the effective length to the total cross sectional area of a elongated members or group of parallel elongated members) of as little as about 84 to about 100, or 260 for the smaller cases to as low as about 100 for the larger cases. These Aspect Ratios can be easily obtained by using multiple parallel members made of the preferred material, especially in larger cases. The holding means includes multiple sockets which precisely position one, two or three pieces of the pultruded material depending on the size and stiffness characteristics desired of the finished luggage case. For example, a small carry-on or duffel may require only one pair of elongated members positioned along the diagonals of each panel. In this situation, the center socket of the three sockets 28 shown in FIG. 3 would be used to hold that elongated member. Larger cases would require perhaps two as shown in the Figures. A large wheeled case perhaps 20 to 22 inches in height may require three of the elongated members grouped in parallel between the holding means 26.

While panels 20 are shown positioned adjacent the smaller ends of the luggage case, other configurations are possible. For example, elongated members could be positioned as disclosed in the front or back panel of a drum style case, or in a divider panel positioned across the center of the case.

Many advantages have been associated with this frame construction. For example, in contrast with the Lightweight case (mentioned supra) which can withstand only a few distortions which bring the top board to the bottom board, cases made in accordance with the instant invention can be crushed hundreds and perhaps thousands of times without appreciable damage to the structural components. Secondly, while cases made with other frames can be made quite light yet durable, this structure saves several ounces associated with the frame structure, a desirable characteristic for a softside luggage case. Also, if in the slim chance that an elongated member would be damaged, the structural panel construction permits easy replacement of those elongated members or their holding means.

I claim:

1. A luggage case having a body of fabric panels supported over a frame means, the frame means including at least one panel which includes a flexible elongated member having a flexural modulus of at least about $1.0\times10^6$ psi, and means for loosely attaching the elongated member to the frame means whereby the elongated member is capable of repeated flexural strain such that the ends thereof can be brought together repeatedly, as when the luggage case is crushed, said elongated member positioned in said panel to provide a restoring force to said panel when the panel is flexed.

2. A luggage case as set forth in claim 1 wherein the panel includes two of said elongated members.

3. A luggage case as set forth in claim 2 wherein said panel includes a pair of flexible laminae with the elongated members sandwiched between them.

4. A luggage case as set forth in claim 3 wherein said panel further includes seam means connecting said laminae to each other at their peripheries.

5. A luggage case as set forth in claim 4 wherein said panel further includes means for holding an end of each said elongated member and for engaging a substantial portion of said seam means.

6. A luggage case as set forth in claim 5 wherein said panel has four corners, with said holding means engaging said seam means at one of said corners.

7. A luggage case as set forth in claim 6 wherein said holding means includes a socket for receiving an end of said elongated means and a seam engaging edge opposite said socket, said edge having a contour which substantially corresponds to the contour of the seam means at the corners.

8. A luggage case as set forth in claim 6 wherein said panel has at least one diagonal defined between a pair of said corners, each said elongated member extends along said diagonal of said panel from one corner to the other of said pair of corners with the pair of the elongated members crossing one another at the middle of the panel.

9. A luggage case as set forth in claim 7 wherein said holding means includes at least two sockets.

10. A luggage case as set forth in claim 8 wherein said panel includes at least four elongated members arranged in pairs along each said diagonal.

11. A luggage case as set forth in any one of claims 2–5 wherein any of said elongated members has a flexural strength of about 120,000 psi, and a flexural yield stress approximately equal to its ultimate stress.

12. A luggage case as set forth in any one of claims 2–5 wherein one of said elongated members has a cross sectional area which is generally uniform along its length and is so dimensioned such that a ratio of its effective length to said total cross sectional area of said elongated member is between 84 and 260.

13. A luggage case as set forth in any one of claims 2–5 wherein said flexural modulus is about $6\times10^6$ psi and said flexural strength is about 120,000 psi.

14. A luggage case as set forth in any one of claims 2–5 wherein any of said elongated members is made of unidirectional fiber reinforced, pultruded thermosetting plastic.

15. A structural panel for a flexible luggage case comprising a generally planar lamina having a predetermined peripheral shape and being formed of a material which resists stretching but is capable of folding or crushing without damage, said peripheral shape including at least four corners, a first elongated member attached to said lamina at least at two of said corners, a second elongated member attached to said lamina and at least at another two of said four corners, such that the elongated members cross one another inward of the said four corners, said elongated members having resiliency characteristics such that ends of the panel can be brought in contact with each other without appreciable damage to the panel or the elongated members.

16. A structural panel as set forth in claim 15 further comprising a second lamina of a material capable of folding or crushing without damage, the first and second laminae attached at their peripheries to form a seam means.

17. A structural panel as set forth in claim 16 further comprising seam engaging means engaging said seam means at said corners, said seam engaging means having at least one socket for receiving an end of one of the elongated members, and including a seam engaging edge which has a contour which corresponds to the seam means at said corners.

18. A structural panel as set forth in claim 16 wherein said elongated members are positioned between said first lamina and said second lamina, one of said laminae includes a zipper closure for selective access to the elongated members between the two laminae.

19. A structural panel as set forth in any of claims 15, 16, 17, or 18 wherein said elongated members comprise a material having a flexural modulus of at least about $1.0\times10^6$ psi, at a flexural strength of at least 60,000 psi, and with an elastic yield stress approximately equal to its ultimate flexural stress.

20. A structural panel as set forth in claim 19 wherein said flexural modulus is about $6\times10^6$ psi, and said flexural strength is about 120,000 psi.

21. A structural panel as set forth in claim 15 wherein each said elongated members has a cross sectional area which is generally uniform along its length and is so dimensioned such that a ratio of its effective length to the said generally uniform cross sectional area of said elongated member is between 84 and 260.

22. A structural panel as set forth in claim 15 wherein each said elongated members is so dimensioned such that a ratio of its effective length to its narrowest cross sectional dimension is between at least about 183 to at least about 260.

23. A structural panel as set forth in claim 15 including groups of parallel elongated members, wherein each said groups of elongated members has a total cross sectional area which is generally uniform along the length of said group of elongated members and is so dimensioned such that a ratio of its effective length to the said cross sectional area is between 84 and 260.

* * * * *